US006575227B1

(12) United States Patent
Leeson et al.

(10) Patent No.: US 6,575,227 B1
(45) Date of Patent: Jun. 10, 2003

(54) HEAT EXCHANGER

(75) Inventors: Jeffrey S. Leeson, South Euclid, OH (US); Eric K. Peoples, Ravenna, OH (US); Michael W. Brakey, Shaker Heights, OH (US)

(73) Assignee: Duramax Marine, LLC, Hiram, OH (US)

( * ) Notice: Subject to any disclaimer, the term of this patent is extended or adjusted under 35 U.S.C. 154(b) by 0 days.

(21) Appl. No.: 09/427,166

(22) Filed: Oct. 26, 1999

(51) Int. Cl.[7] ..... F28D 1/00; F28D 1/02; F28D 1/04

(52) U.S. Cl. ..... 165/44; 165/41; 165/173; 165/174; 440/88

(58) Field of Search ..... 165/44, 41, 173, 165/174; 440/88

(56) References Cited

U.S. PATENT DOCUMENTS 2,415,154 A * 2/1947 Walter ..... 165/44
3,177,936 A * 4/1965 Walter ..... 165/44
3,240,179 A * 3/1966 Van Ranst ..... 164/144
4,338,993 A * 7/1982 Fernstrum ..... 165/44
4,557,319 A * 12/1985 Arnold ..... 165/44
5,931,217 A * 8/1999 Fernstrum ..... 165/44
6,099,373 A * 8/2000 Fernstrum ..... 165/44

* cited by examiner

*Primary Examiner*—John K. Ford
(74) *Attorney, Agent, or Firm*—D. Peter Hochberg; Katherine R. Vieyra; Sean Mellino

(57) ABSTRACT

A keel cooler having a beveled bottom wall, with orifices on the inner wall of the exterior tubes extending into the header, the orifices being in the natural flow path of coolant flow. The orifices are sufficiently large so as not to restrict the flow of coolant. The anode assemblies and drain plugs are mounted on the beveled bottom wall.

22 Claims, 14 Drawing Sheets

HEAT EXCHANGER

BACKGROUND OF THE INVENTION

1. Field of the Invention

This invention relates to heat exchangers, and more particularly to heat exchangers for cooling engines, generators, gear boxes and other heat generating sources in industrial apparatuses having fluid cooled heat sources, such as marine vessels. The invention more particularly relates to open heat exchangers (where heat transfer tubes are exposed to the ambient cooling or heating fluid, rather than being in a shell to shell container holding the cooling or heating fluid) used for cooling heat sources, where the heat exchangers are efficient, and thus have lower weight and volume compared to other heat exchangers known in the art. Alternatively, the heat exchanger according to the invention could be used as heater, wherein relatively cool fluid absorbs heat through the heat transfer tubes.

2. Description of the Prior Art

Heat generating sources in industrial applications such as marine vessels are often cooled by water, other fluids or water mixed with other fluids. For example, in marine vessels used in fresh water and/or salt water, the cooling fluid or coolant flows through the engine or other heat generating source where the coolant picks up heat, and then flows to another part of the plumbing circuit. The heat must be transferred from the coolant to the ambient surroundings, such as the body of water in which the vessel is located. For small engines, such as outboard motors for small boats, ambient water pumped through the engine is a sufficient coolant. However, as the vessel power demand gets larger, ambient water pumped through the engine may continue to provide good cooling of the engine, but also serves as a source of significant contamination damage to the engine. If raw, ambient water were used to cool the engine, the ambient water would carry debris and, particularly if it is salt water, corrosive chemicals to the engine. Therefore, there have been developed various apparatuses for cooling engines and other heat sources. One apparatus for cooling the engine of a vessel is channel steel, which is basically a large quantity of shaped steel which is welded to the bottom of the hull of a vessel for conveying engine coolant and transferring heat from the coolant to the ambient water. Channel steel has severe limitations: it is very inefficient, requiring a large amount of steel in order to obtain the required cooling effect; it is very expensive to attach to a vessel, since it must be welded to the hull—a very labor intensive operation; since channel steel is very heavy, the engine must be large enough to carry the channel steel, rendering both the initial equipment costs and the operating costs very high; the larger, more powerful engines of today are required to carry added channel steel for their cooling capacity with only a relatively small amount of room on the hull to carry it; the payload capacity is decreased; the large amount of channel steel is expensive; and finally, channel steel is inadequate for the present and future demands for cooling modem day, marine vessels. Even though channel steel is the most widely used heat exchanger for vessels, segments of the marine industry are abandoning channel steel and using smaller keel coolers for new construction to overcome the limitations cited earlier.

A keel cooler was developed in the 1940's and is described in U.S. Pat. No. 2,382,218 (Femstrum). The Femstrum patent describes a heat exchanger for attachment to a marine hull structure which is composed of a pair of spaced headers secured to the hull, and a plurality of heat conduction tubes, each of whose cross-section is rectangular, which extend between the headers. Cylindrical plumbing through the hull connects the headers to coolant flow lines extending from the engine or other heat source. Hot coolant leaves the engine, and runs into a heat exchanger header located beneath the water level (the water level refers to the water level preferably below the aerated water, i.e. below the level where foam and bubbles occur), either beneath the hull or on at least one of the lower sides of the hull. The coolant then flows through the respective rectangular heat conduction tubes and goes to the opposite header, from which the cooled coolant returns to the engine. The headers and the heat conduction tubes are disposed in the ambient water, and heat transferred from the coolant, travels through the walls of the heat conduction tubes and the headers, and into the ambient water. The rectangular tubes connecting the two headers are spaced fairly close to each other, to create a large heat flow surface area, while maintaining a relatively compact size and shape. Frequently, these keel coolers are disposed in recesses on the bottom of the hull of a vessel, and sometimes are mounted on the side of the vessel, but in all cases below the water line.

The foregoing keel cooler is referred to as a one-piece keel cooler, since it is an integral unit with its major components welded or brazed in place. The one-piece keel cooler is generally installed and removed in its entirety.

There are various varieties of one-piece keel coolers. Sometimes the keel cooler is a multiple-pass keel cooler where the headers and heat conduction tubes are arranged to allow at least one 180° change in the direction of flow, and the inlet and outlet ports may be located in the same header.

Even though the foregoing heat exchangers with the rectangular heat conduction tubes have enjoyed wide-spread use since their introduction over fifty years ago, they have shortcomings which are corrected by the present invention.

The rectangular heat exchangers of the prior art have the outward shape of a rectangular parallelepiped having headers at their opposite ends. These headers have opposing end walls which are perpendicular to the hull of the vessel and parallel to each other, and act as a barrier to ambient water flow relative to the keel cooler as the vessel with the heat exchanger travels through the water. The perpendicular header walls are responsible for the creation of dead spots (lack of ambient water flow) on the heat exchanger surfaces, which largely reduce the amount of heat transfer occurring at the dead spots. In addition, the perpendicular walls diminish the flow of ambient water between the heat conduction tubes, which reduces or diminishes the amount of heat which can be transferred between the coolant in the tubes and the ambient water.

The ability of a heat exchanger to efficiently transfer heat from a coolant flowing through heat conduction tubes depends, in part, on the volume of coolant which flows through the tubes and its distribution across the parallel set(s) of tubes, and on whether the coolant flow is turbulent or laminar. The volume flow of coolant per tube therefore impacts heat transfer efficiency and pressure drop across the heat exchanger. In the present heat exchanger with rectangular tubes, the ends or extensions of the outermost rectangular tubes form exterior walls of the respective headers. Coolant flowing through the heat exchanger, has limited access to the outermost tubes as determined from data obtained by the present inventors. At the present time, the outermost tubes have a solid outer wall, and a parallel inner wall. In order for coolant to flow into the outermost rectangular tubes, orifices, most often circular in shape, are cut through the inner wall of each of the outer tubes for passing coolant into and out of the outer tubes. The inlet/outlet orifices of the exterior tubes are presently disposed centrally in a vertical direction and endwardly of the respective headers of the keel coolers. However, an analysis of the flow of coolant through the foregoing keel cooler shows that there is a larger amount of coolant per tube flowing through the more central tubes, and much less coolant per tube through the outermost tubes. A graph of the flow through the tubes has a general bell-shaped configuration, with the amount of flow decreasing from the central portion of the tube array. The result is that heat transfer is lower for the outermost tubes, and the overall heat transfer for the keel cooler is also relatively lower, and therefore, the pressure drop across the keel cooler is higher than desired.

The flow of coolant through the respective orifices into the outermost rectangular tubes was found to be inefficient, causing insufficient heat transfer in the outermost tubes. It was found that this occurred because the orifices were located higher and further towards the ends of the respective headers than is required for optimal flow. It has been found by the inventors that enlarging the orifice size and moving it closer to the natural flow path of the coolant flowing through the headers, i.e. its optimal path of flow, coupled with the modification to the design of the header as discussed below, further increased the flow to the outer tubes and made the flow through all of the tubes more uniform, reducing the pressure drop across the cooler while increasing the heat transfer.

The current keel cooler with rectangular heat conduction tubes has an anode and a drain plug or plugs located on the bottom portion of the respective headers, which increases the overall height of the header and which may render these devices subject to potential damage from debris in the water and underwater structures. In order to reduce the likelihood of damage, shrouds have been provided to protect the keel coolers against damage. In addition, the anode(s), and the drain plug(s), by projecting into the ambient water, impede the relative flow of the ambient water as the vessel moves therethrough which increases drag. As explained below, the location of the anode(s) and drain plug(s) so as to minimize the increase height of the header and the keel cooler, reduces the foregoing problems.

As discussed below, the beveled header, and the relocation of the anode assemblies and drain plugs, also contribute to the increase of the overall heat transfer efficiency of the keel cooler according to the invention, since the ambient water is caused to flow towards and between the respective heat conduction tubes, rendering the heat transfer substantially higher than in the keel cooler presently being used. This increase in heat transfer is due at least in part to the increase in turbulence in the flow of ambient water across the forward header and along and between the coolant flow tubes.

One of the important aspects of keel coolers for vessels is the requirement that they take up as small an area on the vessel as possible, while fulfilling or exceeding their heat exchange requirement with minimized pressure drops in coolant flow. The area on the vessel hull which is used to accommodate a keel cooler is referred to in the art as the footprint. In general, keel coolers with the smallest footprint and least internal pressure drops are desirable. One of the reasons that the keel cooler described above with the rectangular heat conduction tubes has become so popular, is because of the small footprint it requires when compared with other keel coolers. However, keel coolers according to the design of rectangular tubed keel coolers presently being used have been found by the present inventors to be larger than necessary both in terms of size and the related internal pressure drop. By the incorporation of the various aspects of the present invention described above (and in further detail below), keel coolers having smaller footprints and lower internal pressure drops are possible. These are major advantages of the present invention.

Some of the shortcomings of heat exchangers with rectangular heat conduction tubes presently being used relate to the imbalance in the coolant flow among the parallel tubes, in particular in keel coolers which lead to both excessive pressure drops and inferior heat transfer which can be improved according to the present invention. The unequal distribution of coolant flow through the heat conduction tubes in present rectangular tube systems has led to inferior heat transfer in the systems. In order to attend to this inferior heat transfer, the designers of the present keel coolers on the market have been compelled to enlarge or oversize the keel cooler which also may increase the footprint, through additional tube surface area, to overcome the poor coolant distribution and inferior heat transfer in the system. This has resulted in the present one piece keel coolers which are unnecessarily oversized when compared with the invention described below. In some instances, the invention described below would result in fewer keel coolers in cooling circuits which require multiple keel coolers.

The unequal distribution of coolant flow through the heat conduction tubes in present rectangular tube systems also results in higher internal pressure drops in the systems. This higher pressure drop is another reason that the prior art requires oversized heat exchangers. Excessive oversizing compensates for poor heat transfer efficiency and excessive pressure drops, but this requires added costs and a larger footprint.

When multiple pass (usually two pass) keel coolers are specified for the present state of the art, an even greater differential size is required when compared with the present invention, as described below.

SUMMARY OF THE INVENTION

It is an object of the present invention to provide a heat exchanger for fluid cooled heat sources which is smaller than corresponding heat exchangers having the same heat exchange capability.

Another object of the present invention is to provide an improved heat exchanger for industrial applications which is more efficient than heat exchangers presently known and used.

It is yet another object of the present invention to provide an improved one-piece heat exchanger for vessels which is more efficient in heat transfer than presently known one-piece heat exchangers.

It is an additional object to produce a one-piece heat exchanger and headers thereof which generally equalizes the flow of coolant through each of the tubes of the keel cooler.

A further object is to provide an improved one-piece heat exchanger which reduces the pressure drop of coolant flowing therethrough.

A further object of the present invention is to provide an improved one-piece heat exchanger having heat conduction tubes which are rectangular in cross-section having a length which is reduced in size from the current heat exchangers due to improved coolant flow distribution inside the heat exchanger and enhanced ambient water flow across the keel cooler.

Another object is to provide an improved one-piece heat exchanger having a reduced size from present one-piece heat exchangers of comparable heat transfer capability, by reducing the length of the heat transfer tubes, the number of tubes and/or the size of the tubes.

A still further object of the present invention is to provide a new one-piece heat exchanger having rectangular shaped heat conduction tubes which has enhanced durability compared to keel coolers presently on the market.

A related object of the invention is to provide an improved heat exchanger and headers thereof which is capable of deflecting debris more readily, and for presenting a smaller target to debris in the ambient water.

It is another object to provide a keel cooler and header thereof which projects into the water from the hull by a lesser amount than the corresponding one-piece keel coolers and headers thereof.

Another object of the present invention is to provide an improved one-piece keel cooler which is easier to install on vessels than corresponding keel coolers presently on the market.

It is still another object of the invention to provide a one-piece heat exchanger having a reduced pressure drop and a more uniform distribution of coolant flowing therethrough than heat exchangers presently on the market, for increasing the amount of coolant flowing through the heat exchanger to improve its capacity to transfer heat.

Yet a further object of the present invention is to provide a one-piece heat exchanger and a header having a lower weight, and therefore lower cost, than corresponding one-piece heat exchangers presently in use.

Another object of the present invention is to provide a one-piece heat exchanger and headers thereof having rectangular heat conduction tubes having a lower pressure drop in coolant flowing through the heat exchanger than corresponding heat exchangers presently known.

Another object of the present invention is the provision of a one-piece heat exchanger for a vessel, for use as a retrofit for previously installed one-piece heat exchangers which will surpass the overall heat transfer performance and provide lower pressure drops than the prior units without requiring additional plumbing, or requiring additional space requirements, to accommodate a greater heat output.

It is another object of the invention to provide an improved header for a one-piece heat exchanger having rectangular coolant flow tubes.

Another object is to provide an improved header for a one-piece heat exchanger with rectangular coolant flow tubes which reduces the dead spots which have heretofore reduced the heat transfer capabilities of one-piece heat exchangers, the dead spots reducing the flow of ambient water around and between the coolant flow tubes.

A further object of the invention is to provide an improved header for a one-piece keel cooler with rectangular coolant flow tubes, by reducing the likelihood of damage to the header from striking debris and underwater objects which could damage the keel cooler.

It is still another object for the provision of a header for effecting increased turbulent flow of the ambient water flowing between and around the heat transfer tubes.

It is an additional object to provide an improved header for one-piece keel coolers which enables the anode for such keel coolers to be less likely to strike debris and underwater objects.

Another object is the provision of a keel cooler having a smaller, and more streamlined profile to reduce drag as the vessel with the keel cooler moves through the ambient water.

Another object is to provide a header for a one-piece heat exchanger which provides for enhanced heat exchange between the coolant and the ambient cooling medium such as water.

Yet a further object is to provide a header for a one-piece heat exchanger which provides for more uniform flow of coolant through all tubes of the keel cooler, to improve the heat transfer as compared to equivalent, current headers.

A general object of the present invention is to provide a one-piece heat exchanger and headers thereof which is efficient and effective in manufacture and use.

Other objects will become apparent from the description to follow and from the appended claims.

The invention to which this application is directed is a one-piece heat exchanger, i.e. heat exchangers having two headers which are integral with coolant flow tubes. It is particularly applicable to heat exchangers used on marine vessels as discussed earlier, which in that context are also called keel coolers. However, heat exchangers according to the present invention can also be used for cooling heat generating sources (or heating cool or cold fluid) in other situations such as industrial and scientific equipment, and therefore the term heat exchangers covers the broader description of the product discussed herein. The heat exchanger includes two headers, and one or more coolant flow tubes integral with the header.

DESCRIPTION OF THE PREFERRED EMBODIMENTS

Figure 1:
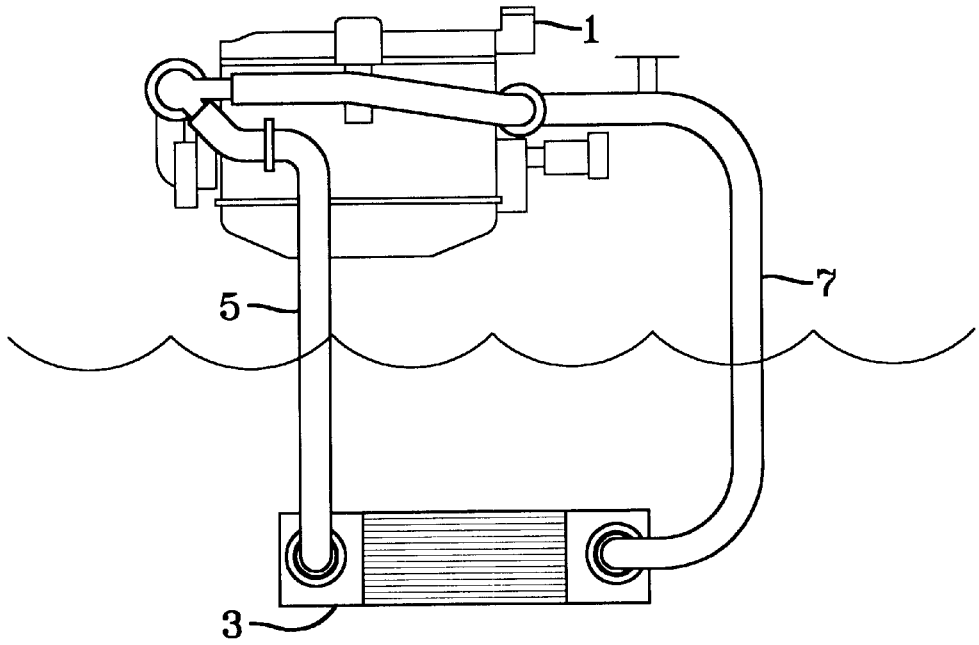
FIG. 1 is a schematic view of a heat exchanger on a vessel in the water.

The fundamental components of a heat exchanger system for a water going vessel are shown in FIG. 1. The system includes a heat source 1, a heat exchanger 3, a pipe 5 for conveying the hot coolant from heat source 1 to heat exchanger 3, and a pipe 7 for conveying cooled coolant from heat exchanger 3 to heat source 1. Heat source 1 could be an engine, a generator or other heat source for the vessel. Heat exchanger 3 could be a one-piece keel cooler (since only one-piece keel coolers are discussed herein, they are generally only referred to herein as "keel coolers.") Heat exchanger 3 is located in the ambient water, below the water line (i.e. below the aerated water line), and heat from the hot coolant is transferred through the walls of heat exchanger 3 and expelled into the cooler ambient water.

Figure 2:
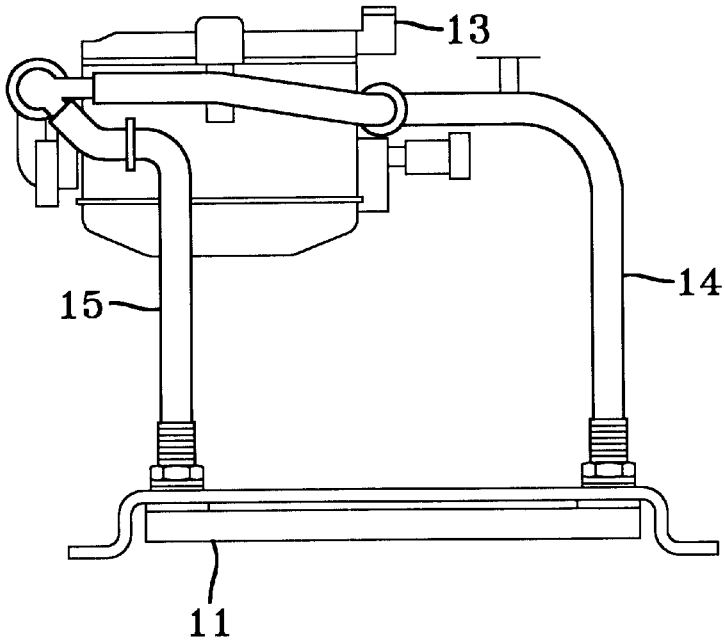
FIG-2 PRIOR ART
FIG. 2 is a side view of an engine for a vessel having a one-piece keel cooler according to the prior art installed on the vessel and connected to the engine.

FIG. 2 shows a heat exchanger 11 mounted on a vessel, for transferring heat from the coolant flowing from an engine or other heat source 13 to the ambient water. Coolant flows from one of lines 14 or 15 from engine 13 to keel cooler 11, and back through the other flow pipe from keel cooler 11 to engine 13. Keel cooler 11 is attached to, but spaced from the hull of vessel.

Figure 3:
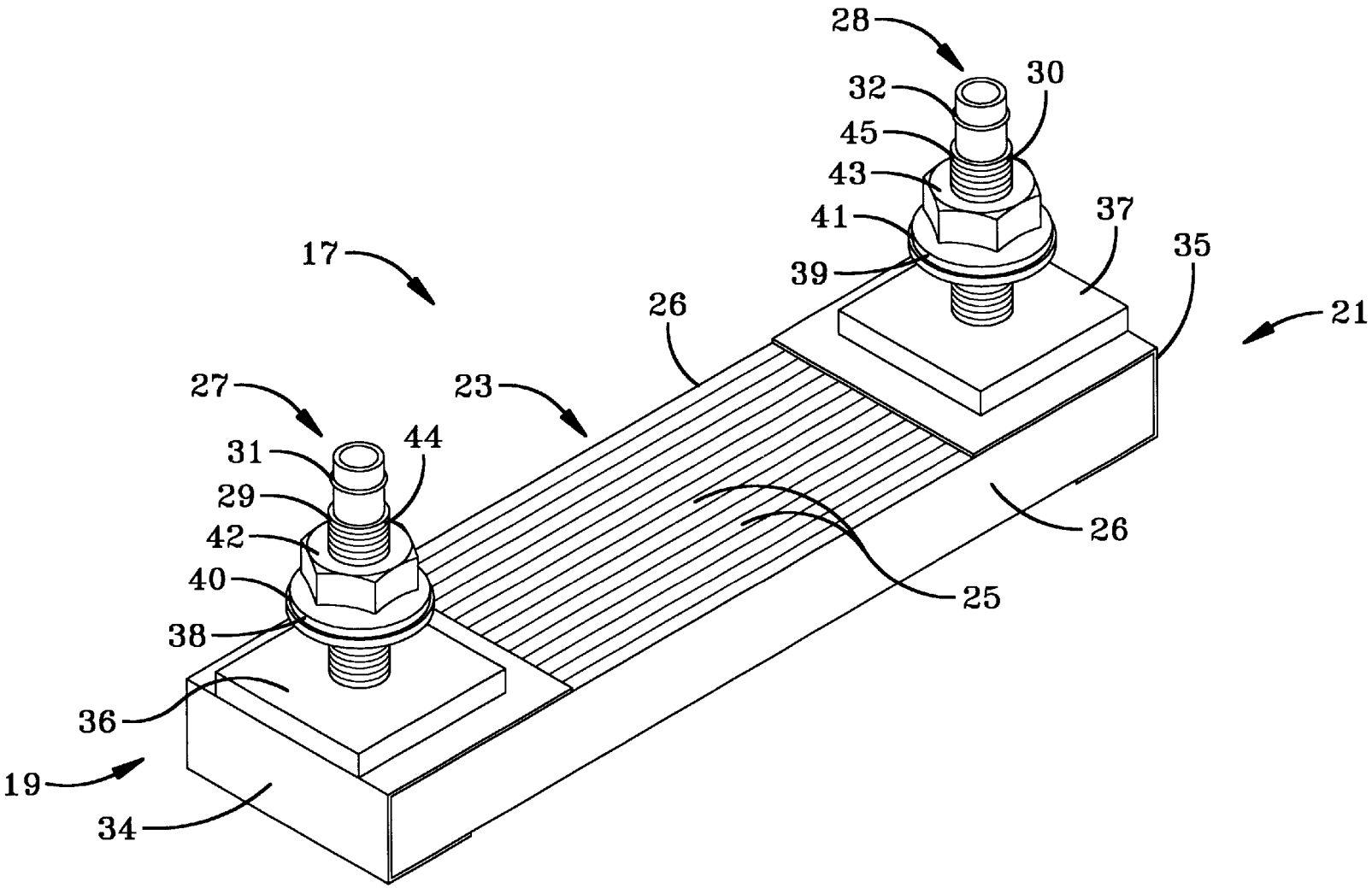
FIG. 3 is a pictorial view of a keel cooler according to the prior art.

A keel cooler 17 according to the prior art is shown in FIG. 3. It includes a pair of headers 19, 21 at opposite ends of a set of parallel, rectangular heat conductor tubes 23, having interior tubes 25 and two exterior tubes (discussed below). A pair of nozzles 27, 28 conduct coolant into and out of keel cooler 17. Nozzles 27, 28 have cylindrical threaded connectors 29, 30, and nipples 31, 32 at the ends of the nozzles. Headers 19, 21 have a generally prismatic construction, and their ends 34, 35 are perpendicular to the parallel planes in which the upper and lower surfaces of tubes 23 are located. Keel cooler 17 is connected to the hull of a vessel through which nozzles 27 and 28 extend. Large gaskets 36, 37 each have one side against headers 19, 21 respectively, and the other side engages the hull of the vessel. Rubber washers 38, 39 are disposed on the inside of the hull when keel cooler 17 is installed on a vessel, and metal washers 40, 41 sit on rubber washers 38, 39. Nuts 42, 43, which typically are made from metal compatible with the nozzle, screw down on sets of threads 44, 45 on connectors 29, 30 to tighten the gaskets and rubber washers against the hull to hold keel cooler 17 in place and seal the hull penetrations from leaks Turning to FIG. 4, a partial, cross section of the current keel cooler according to the prior art and depicted in FIG. 3, is shown. Keel cooler 17 is composed of the set of parallel heat conduction or coolant flow tubes 23 and the header or manifold 19. Nozzle 27 is connected to header 19 as described below. Nozzle 27 has nipple 31, and connector 29 has threads 44 as described above, as well as washer 40 and nut 42. Nipple 31 of nozzle 27 is normally brazed or welded inside of a connector 29 which extends inside the hull. Header 19 has an upper wall or roof 47, outer back wall 34, and a bottom wall or floor 48. Header 19 includes a series of fingers 52 which are inclined with respect to tubes 23, and define spaces to receive ends 55 of interior tubes 25.

Figure 5:
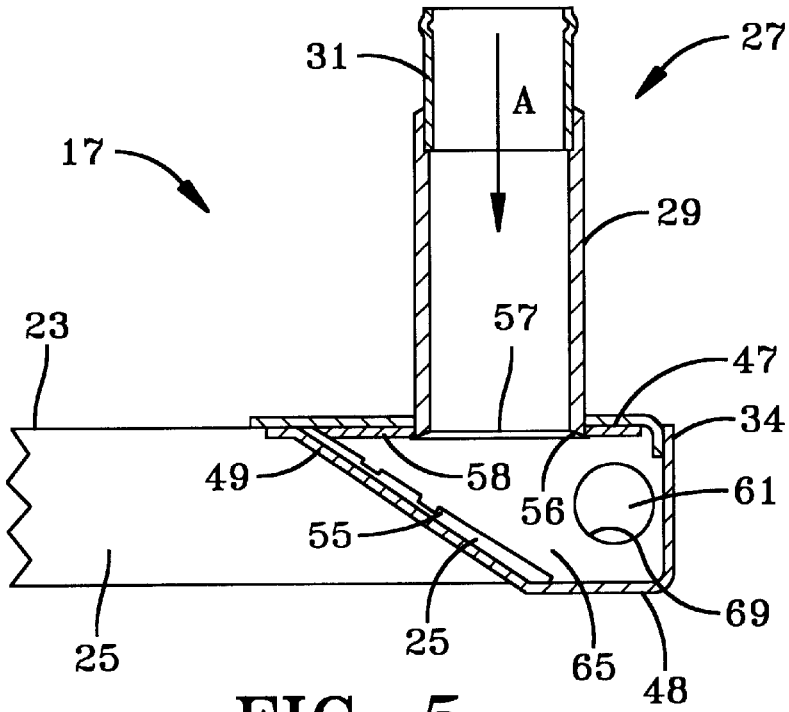
FIG-5 PRIOR ART
FIG. 5 is a cross-sectional view of a portion of a keel cooler according to the prior art, showing a header and part of the coolant flow tubes.

Referring also to FIG. 5, which shows keel cooler 17 and header 19 in cross section, header 19 further includes an inclined surface or wall 49 composed of fingers 52. End portions 55 of interior tubes 25 extend through surface 49. Interior tubes 25 are brazed or welded to fingers 52 to form a continuous surface. A flange 56 surrounds an inside orifice 57 through which nozzle 27 extends and is provided for helping support nozzle 27 in a perpendicular position on the header 19. Flange 56 engages a reinforcement plate 58 on the underside of wall 47.

In the discussion above and to follow, the terms "upper", "inner", "downward", "end" etc. refer to the heat exchanger, keel cooler or header as viewed in a horizontal position as shown in FIG. 5. This is done realizing that these units, such as when used on water going vessels, can be mounted on the side of the vessel, or inclined on the fore or aft end of the hull, or various other positions.

Figure 4:
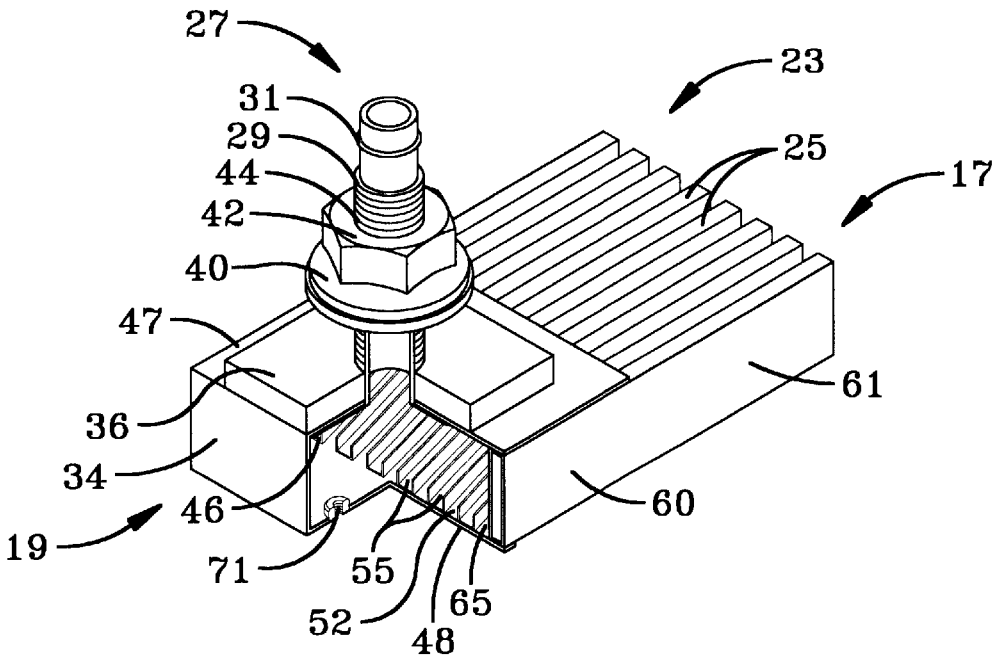
FIG–4 PRIOR ART
FIG. 4 is a partial pictorial view of a partially cut-away header and a portion of the coolant flow tubes of a one-piece keel cooler according to the prior art.

Each exterior side wall of header 19 is comprised of an exterior or outer rectangular tube, one of which is indicated by numeral 60 in FIG. 4. The outer tubes extend into header 19. FIGS. 4 and 5 show both sides of outside tube wall 61. Both sides of interior wall 65 are shown in FIGS. 4 and 5. A circular orifice 69 is shown extending through interior wall 65 of the outside rectangular tube of keel cooler 17, and is provided for carrying coolant flowing through the outside tube into or out of header 19. In this regard, nozzle 27 can either be an inlet conduit for receiving hot coolant from the engine whose flow is indicated by the arrow A in FIG. 5, but also could be an outlet conduit for receiving cooled coolant from header 19 for circulation back to the heat source. It is important to note that in the prior art, the location and size of orifice 69 limits the amount of flow which can pass through orifice 69. More particularly, the orifice has heretofore been mounted too high, is too small, and too far away from the natural flow path of the coolant, resulting in reduced flow through the outer rectangular tubes, non-uniform coolant flow through tubes 23, and a disadvantageously high pressure drop as the coolant flows through the orifices, and at higher rates through the less restricted inner tubes—even though the outermost tubes have the greatest ability to transfer heat.

FIG. 4 also shows that keel cooler header 19 has a drainage orifice 71 for receiving a correspondingly threaded and removable plug. The contents of keel cooler 17 can be removed through orifice 71.

Orifice 57 is separated by a fairly large distance from the location of orifice 69, resulting in a reduced amount of flow through each orifice 69, the reduction in flow being largely due to the absence of the orifice in the natural flow path of the coolant. Although this problem has existed for five decades, it was only when the inventors of the present invention were able to analyze the full, flow characteristics that they verified the importance of properly locating and sizing the orifice. In addition, the configuration of the header in both single pass and multiple pass systems affects the flow through the header as discussed below.

Still referring to the prior art header 19 shown in FIGS. 3–5, it can be seen that outer back wall 34 and floor 48 are formed at right angles. This configuration has led to a number of disadvantages, previously unrecognized by those designing and working on keel coolers. First, by having wall 34 perpendicular to the direction of flow of the coolant through the tubes, greater pressure drops occur inside of header 19 as the coolant becomes chaotically turbulent and is forced through the coolant flow tubes at varying flow rates depending on resistance. This coupled with the poor location and size of orifice 69 leads to a net reduction in flow and thus of heat transferred from the coolant through outer tubes 60 of keel cooler 17. With respect to the outside of wall 34, the vertical wall acts as an obstruction to the flow of ambient water, and diminishes the amount of ambient water which is able to flow between and around tubes 23. In addition, vertical wall 34 serves as an obstruction to debris in the ambient water and absorbs the full impact of the debris leading to potential damage to the keel cooler. Moreover, having wall 34 and floor 48 defining a right angle increases the amount of material used for keel cooler 17, which adds to its expense. Most keel coolers are made from 90-10 copper-nickel (or some other material having a large amount of copper), which is a relatively expensive material. In addition, significant drag is created by the resistance which the vertical wall presents to ambient water, as well as the protruding anode(s) and drain plug(s) (discussed below) mounted on floor 48. This restricts the flow of ambient water to the heat exchange tubes of the keel cooler, increases the required depth of the keel cooler which may increase the likelihood of it being hit by debris, as well as lowering the depth of the vessel and increasing the probability of damage by underlying structures, and adds to the drag of the vessel as it moves through the water.

Still referring to FIGS. 3–5, gaskets 36, 37 are provided for three essential purposes: (1) they insulate the header to prevent galvanic corrosion, (2) they eliminate infiltration of ambient water into the vessel, and (3) they permit heat transfer in the space between the keel cooler tubes and the vessel by creating a distance of separation between the heat exchanger and the vessel hull, allowing ambient water to flow through that space. Gaskets 36, 37 are generally made from a polymeric substance. In typical situations, gaskets 36, 37 are between one quarter inch and three quarter inches thick. Keel cooler 17 is installed on a vessel as explained above. The plumbing from the vessel is attached by means of hoses to nipple 31 and connector 29 and to nipple 32 and connector 30. A cofferdam or sea chest (part of the vessel) at each end (not shown) contains both the portion of the nozzle 27 and nut 42 directly inside the hull. Sea chests are provided to prevent the flow of ambient water into the vessel should the keel cooler be severely damaged or torn away, where ambient water would otherwise flow with little restriction into the vessel at the penetration location.

Referring next to FIGS. 6–11, the invention in the preferred embodiment is shown. The embodiment includes a keel cooler 200 with coolant flow tubes (or heat transfer fluid flow tubes, since in some instances the fluid may be heated instead of cooled) 202 having a generally rectangular cross section. A header 204 is an integral part of keel cooler 200. Tubes 202 include interior or inner coolant flow tubes 206 and outermost or exterior tubes 208. A nozzle 27 having nipple 31 and threaded connector 29, are the same as those described earlier and are attached to the header. Header 204 includes an upper wall or roof 210, a beveled closed end portion 212 having an end wall 214 transverse to (and preferably perpendicular to) upper wall 210 and a beveled, bottom wall 216 beginning at end wall 214 and terminating at a generally flat lower wall 217. Beveled wall 216 should be greater in length (from end wall 214 to lower wall 217) than the height of end wall 214. An interior wall 218 (FIGS. 6–7) of exterior or outermost rectangular flow tube 208 has an orifice 220 (one per header for each tube 208) which is provided as a coolant flow port for coolant flowing between the chamber of header 204 and outer flow tubes 208 (The chamber is defined by upper wall 210, an inclined surface or inner end or inlet end portion 229, beveled bottom wall 216, lower wall 217 and end wall 214). Header 204 also has an anode assembly 222 (shown in FIG. 6) for reducing corrosion of the keel cooler.

Anode assembly 222 includes a steel anode plug(s) 223 which is connected to an anode insert(s) 224 which is part of header 204, an anode mounting screw(s) 242, a lockwasher(s) 246 (FIG. 11) and anode bar 228, which is normally made of zinc. The anode insert, the anode plug and the anode bar have not changed from the prior art, but were omitted from FIGS. 3 and 4 for the sake of clarity. However, the location of the anode assembly has changed as explained below.

Figure 7:
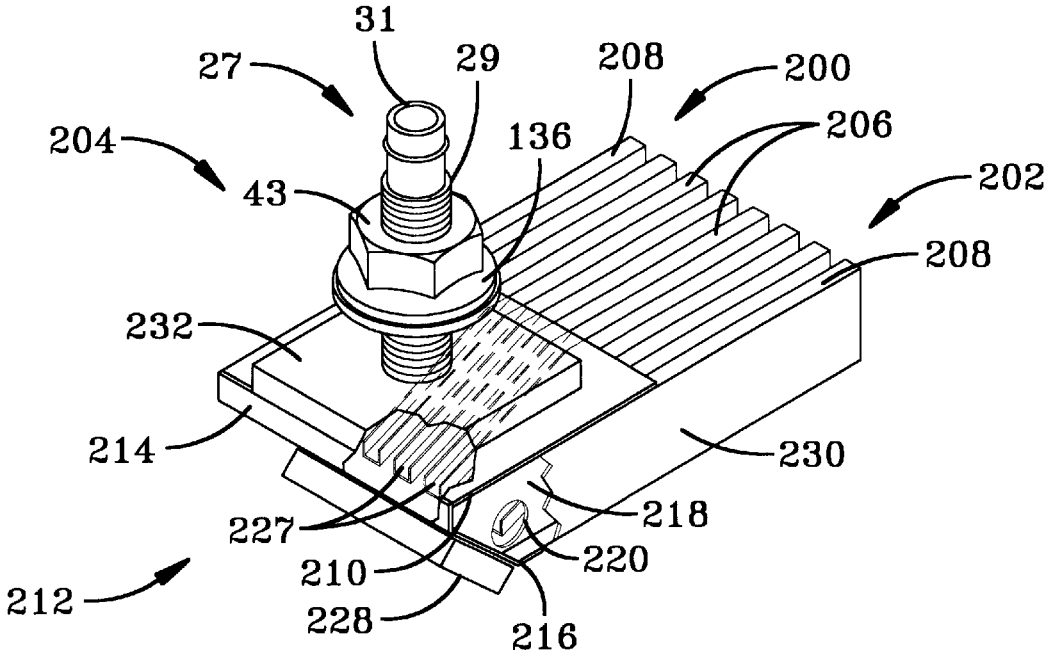
FIG. 7 is a pictorial view of a portion of a one-piece keel cooler according to the invention, with portions cut away.

Considering specifically cut away FIG. 7, keel cooler 200 includes rectangular tubes 202 with interior tubes 206 and outermost tubes 208, and inner wall 218 (with orifice 220) of the outermost tubes. The open ends or inlets or ports for interior tubes 206 are shown by numerals 227. Tubes 206 join header 204 through inclined surface 229 (FIG. 6) on the opposite part of header 204 from beveled wall 216. Exterior tubes 208 have outer walls 230, part of which are also the side walls of header 204. A gasket 232, similar to and for the same purpose as gasket 36, is disposed on roof 210.

An important part of the present invention is the beveled closed end portion 212. Beveled closed end portion 212, with beveled bottom wall 216, provides a number of important advantages to the keel cooler. First, being beveled as shown, it enhances the continuous flow of coolant either from heat conduction tubes 202 into nozzle 27, where nozzle 27 is an outlet nozzle, or from nozzle 27 into tubes 202, where nozzle 27 is an inlet nozzle. When nozzle 27 is an inlet, beveled wall 216 in cooperation with the angled surface 229 acts to direct the flow of coolant into orifice 220 and openings 227, i.e. beveled wall 216 directs the natural flow of coolant from the nozzle 27 to orifices 220 and tube openings 227. It can be seen that the beveled end portion 212 either distributes the coolant more uniformly across inlets 227 to each of tubes 202 (including orifices 220 in interior wall 218 of exterior tubes 208, or from tubes 202 for discharge of coolant into nozzle 27 where nozzle 27 is an outlet nozzle). The increased coolant flow in the outermost tubes results in improved coolant flow distribution among all the tubes, which provides a lower pressure drop across the entire system and greater heat transfer between the coolant, through tubes 202 and through the walls of header 204, and the ambient water. For example, for a keel cooler having eight rectangular tubes whose external dimensions are 2½ inches in height and ½ inch in width, and the keel cooler is mounted on a vessel with a 2 knot speed, the coolant flow to the outer tubes increased by about 35% over the flow under corresponding heat exchange conditions using the prior art heat exchanger of the same size (i.e. the numbers of tubes and lengths of the tubes) as shown in FIGS. 3–5, which had poor flow distribution. In addition, the heat transferred by the exterior tubes increased by 45% over the corresponding heat transfer under corresponding conditions using the prior art keel cooler shown in FIGS. 3–5. The total heat transfer of the entire system increased by about 17% in a particular instance over the corresponding unit of FIGS. 3–5. As explained below, the improvement over the prior art is expected to be even greater for two pass systems. Also, as discussed later, the deficiencies of the prior art for higher coolant flows, are not experienced to the same extent by the keel cooler according to the invention.

The angle of beveled wall 216 is an important part of the present invention. As discussed herein, the angle, designated as θ (theta), is appropriately measured from the plane perpendicular to the longitudinal direction of coolant flow tubes 202 and located at the part of the closed end portion of header 204 spaced furthest from the set of open ends or ports 227 of tubes 206, i.e. from end wall 214, to beveled wall 216. Angle θ is described as an exterior angle, since it is exterior to end wall 214 and beveled bottom wall 216; it is measured from a plane perpendicular to the longitudinal axes of the flow tubes 202 and roof 210, and it is along end wall 214 at the beginning of beveled bottom wall 216. The factors for determining angle θ are to maintain the center to center distance of the nozzle spacing, to maintain the overall length of the keel cooler, to provide vertical drop beneath the roof of the header so that the header can hold the anode insert, to keep the anode assembly from extending longitudinally beyond wall 214, and to allow for the maximum length of heat transfer tubing (and the associated reduction of the length of the header). Angle θ could be affected by the size of orifice 220, but generally the other factors limit angle θ before the orifice would affect it.

Another important aspect to beveled wall 216 is the manner in which it directs the flow of ambient water over and between the exterior walls of coolant flow tubes 202, to increase the heat transfer between the coolant inside the tubes and the outside ambient water. It will be recalled that under the prior art as shown in FIGS. 3–5, vertical wall 34 diverted the ambient water as the vessel passed therethrough, so that the ambient water to a significant extent went around rather than between and over the separated rectangular tubes 27.

Figure 6:
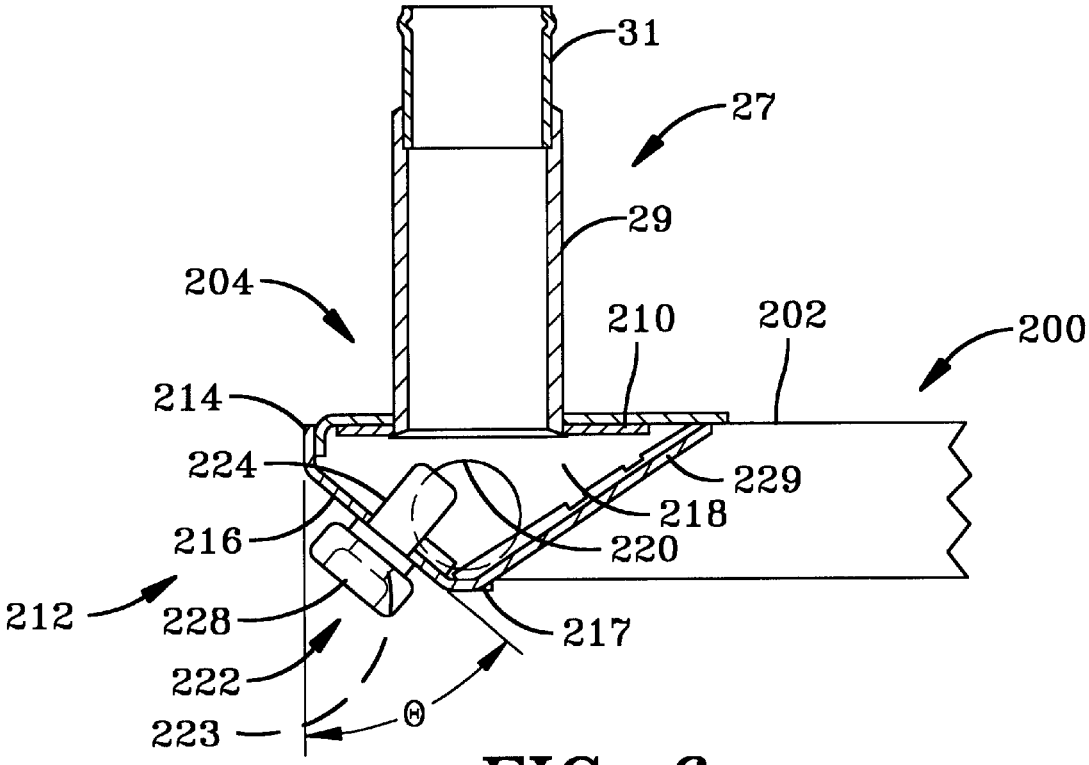
FIG. 6 is a side, cross-sectional, partial view of a portion of one-piece keel cooler according to the invention, showing a header and part of the coolant flow tubes.
Figure 8:
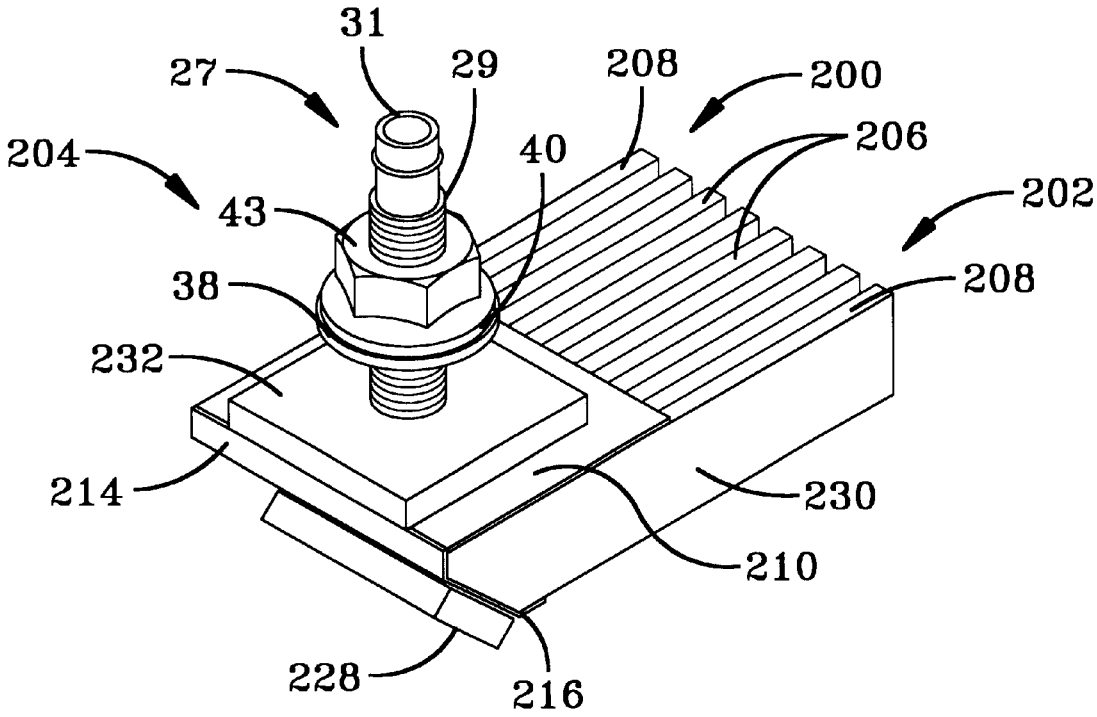
FIG. 8 is a pictorial view of a header and part of the coolant flow tubes of a one-piece keel cooler according to the invention.
Figure 9:
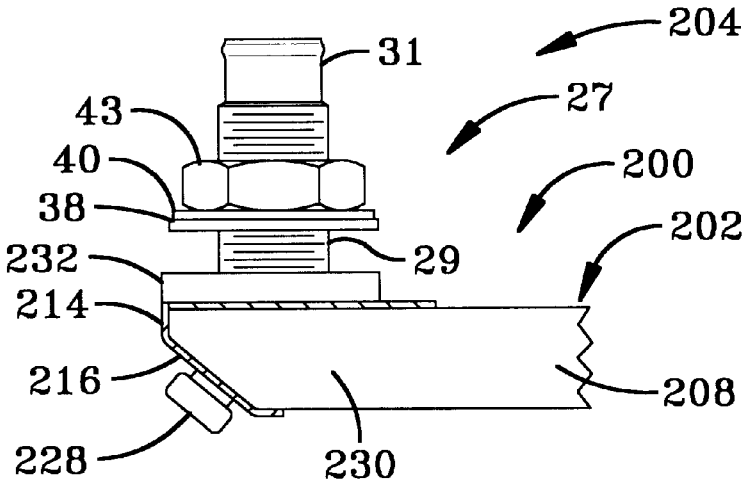
FIG. 9 is a side view of part of the apparatus shown in FIG. 8.
Figure 11:
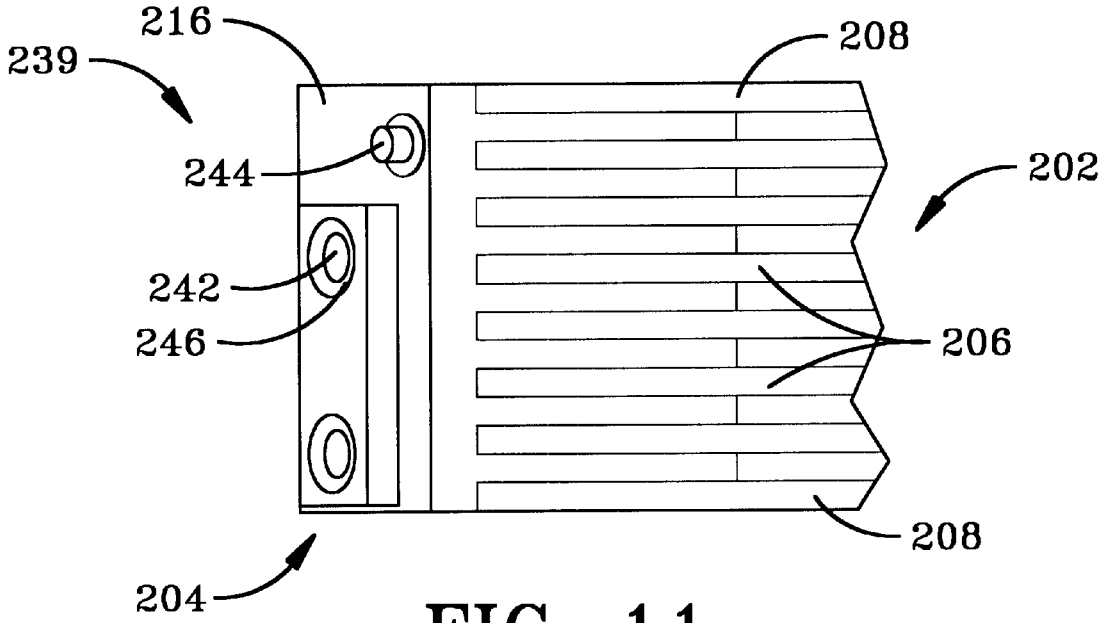
FIG. 11 is a partial bottom view of the apparatus shown in FIG. 8.

It is desirable not to increase the depth of a keel cooler any more than necessary, to make it less likely to strike debris in the water, and less likely to strike underwater objects or the ground beneath the vessel, i.e. the bottom. For this reason, anode assembly 222 is preferably mounted on beveled wall 216. As shown in FIGS. 6 and 11, anode bar 228 of anode assembly 222 is attached to beveled wall 216, by anode screws 242 which extend through lockwashers 246 and into anode insert 224. Anode insert 224 extends from wall 216 into header 204. This decreases the depth of anode assembly according to the prior art, under which anode assembly 222 would have extended from lower wall 217.

Figure 10:
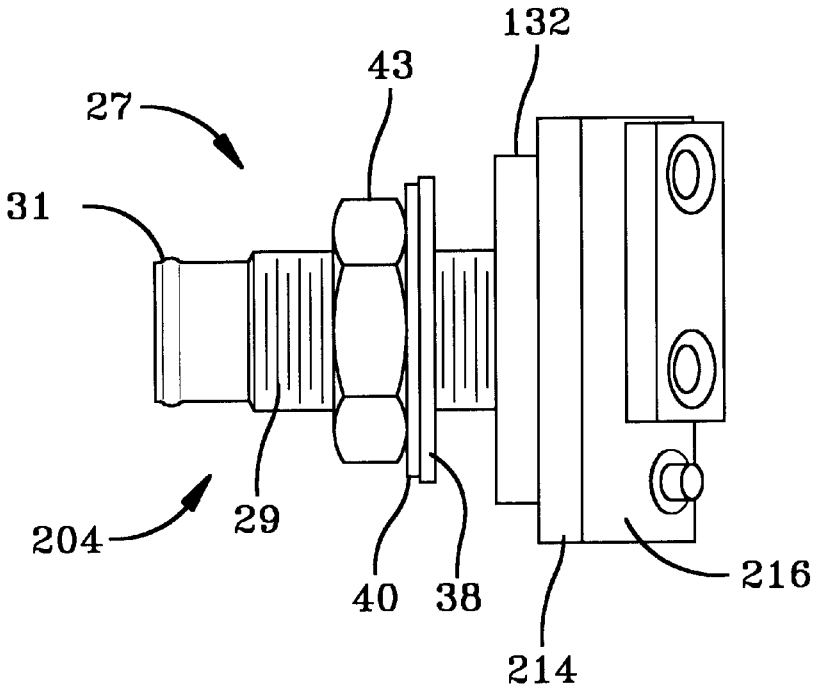
FIG. 10 is a front view of the apparatus shown in FIG. 8.
Figure 12:
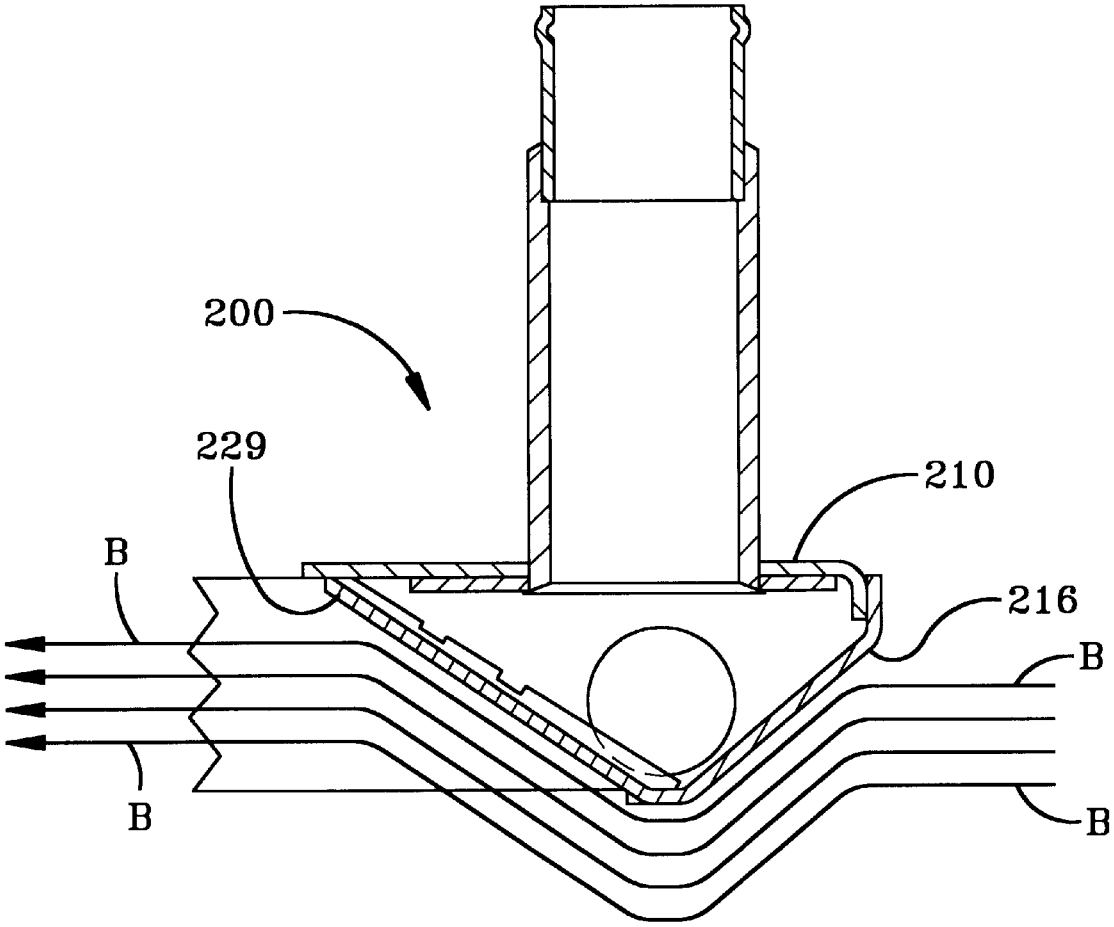
FIG. 12 is a side view of a portion of a header according to the invention showing the flow lines of ambient water.

As shown most clearly in FIGS. 10 and 11, drain plug 244 is also preferably located on beveled wall 216 to avoid plug 244 from striking debris in the water or hitting bottom. More importantly, the drain plug and anode located on the beveled surface have less interference with the ambient water flow pattern (FIG. 12, arrows B). Drain plug 244 extends into a drain plug insert which is part of the header. Under the prior art, drain plug 244 would otherwise have extended from lower wall 217.

Referring to FIG. 12, which shows a side view of keel cooler 200, arrows B show the flow pattern of ambient water across keel cooler 200 as the keel cooler moves to the right through the ambient water. Arrows B show that the water impinges on beveled wall 216, flows around the beveled wall, and, due to the drop in pressure, along inclined surface 229 and up and between coolant flow tubes 202. This flow is turbulent which greatly increases the transfer of heat from the heat conduction tubes as compared to the prior art shown in FIGS. 3–5, yielding a more efficient and effective heat exchanger than those of the prior art. Additionally, having drain plug 244 and anode bar 228 on beveled wall 216 causes less interference with the ambient water flow pattern shown by arrows B. They contribute to the improved heat transfer efficiency.

Figure 13:
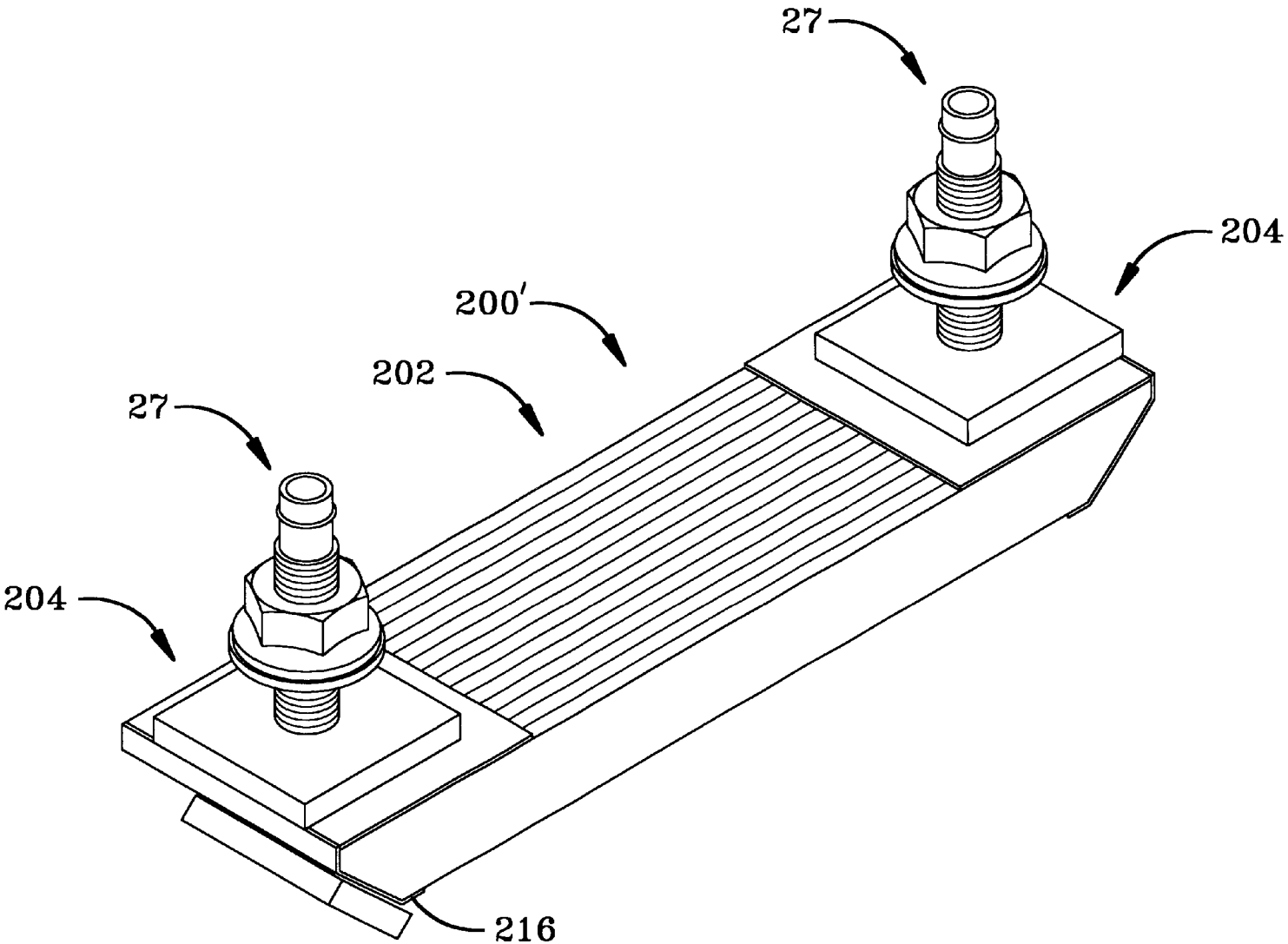
FIG. 13 is a pictorial view of a keel cooler according to the invention.

Keel coolers according to the invention are used as they have been in the prior art, and incorporate two headers which are connected by an array of parallel coolant flow tubes. A common keel cooler according to the invention is shown in FIG. 13, which illustrates a keel cooler 200' having opposing headers 204 like the one shown in FIG. 7. The headers shown have the identical numbers to those shown in FIG. 7. Heated coolant fluid flows into one nozzle 27 from a heat source in the vessel, then flows through one header 204, the coolant flow tubes 202, the other header 204, the other nozzle 27, and the cooled coolant flows back to the heat source in the vessel. While flowing through headers 204 and coolant flow tubes 202, the coolant transfers heat to the ambient water. All of the advantages of the beveled wall 216 apply to keel cooler 200'.

As mentioned above, the size of orifice 220 is an important part of the new keel cooler and the new header. It is desirable to have the orifice be sufficiently large to not impede the amount of coolant flow to exterior heat conduction tubes 208 of the keel cooler, and to implement a balanced flow near the juncture of beveled wall 216 and the interior of surface 229 and ports 227. It has been found that a distance of about ⅛ of an inch between orifice 220 and walls adjacent its lower edge (the interior of the lower parts of wall 216, wall 217 and surface 229, as shown in FIG. 6) be provided for manufacturing tolerance as it is fabricated, which is advantageously done by drilling or cutting orifice 220 into wall 218. It is important that the coolant flow into exterior tubes 208 be near the bottom of walls 218, rather than closer to their top. The distance between the top of orifice 220 and roof 210 is not as crucial. The proper size and placement of orifice 220 thus reduces the pressure drop of the coolant in the entire system of keel cooler 200, balances the flow among the multiple tubes, and thus increases the heat transfer through the outer tubes and therefore the entire unit.

Figure 14:
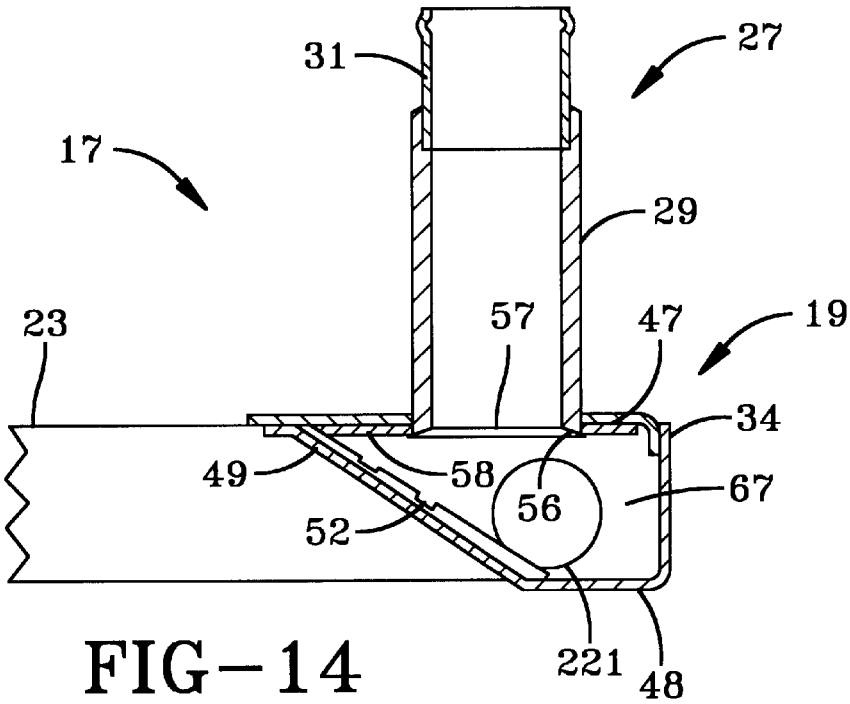
FIG. 14 is a cross-sectional view of a portion of a keel cooler substantially according to the prior art, but the orifice for the flow of coolant between the header and the outermost coolant flow tube, is constructed according to the invention.

While the embodiment under discussion is a beveled keel cooler, the size and location of the orifice to the outermost tubes in a one-piece keel cooler according the prior art as shown in FIGS. 3–5 is significantly improved according to the present invention. FIG. 14 shows a keel cooler header and an outermost coolant flow tube much as was shown in FIG. 5 (and corresponding parts have corresponding numbers), except that orifice 69 has been replaced by orifice 221. Orifice 221 has been moved closer to the openings of the inner coolant flow tubes, has been moved lower, and its size has been increased significantly, so that it is as large as possible within the area permitted on wall 67. Relocated and enlarged orifice 221 enables more coolant fluid to flow into the outermost coolant flow tubes (or from it if the flow were to proceed out of nozzle 27). As explained in the preceding paragraph, the use of orifice 221 reduces the pressure drop of the coolant and balances the flow of coolant amongst the coolant flow tubes, thus increasing heat transfer for the keel cooler (or other heat exchanger).

Figure 15:
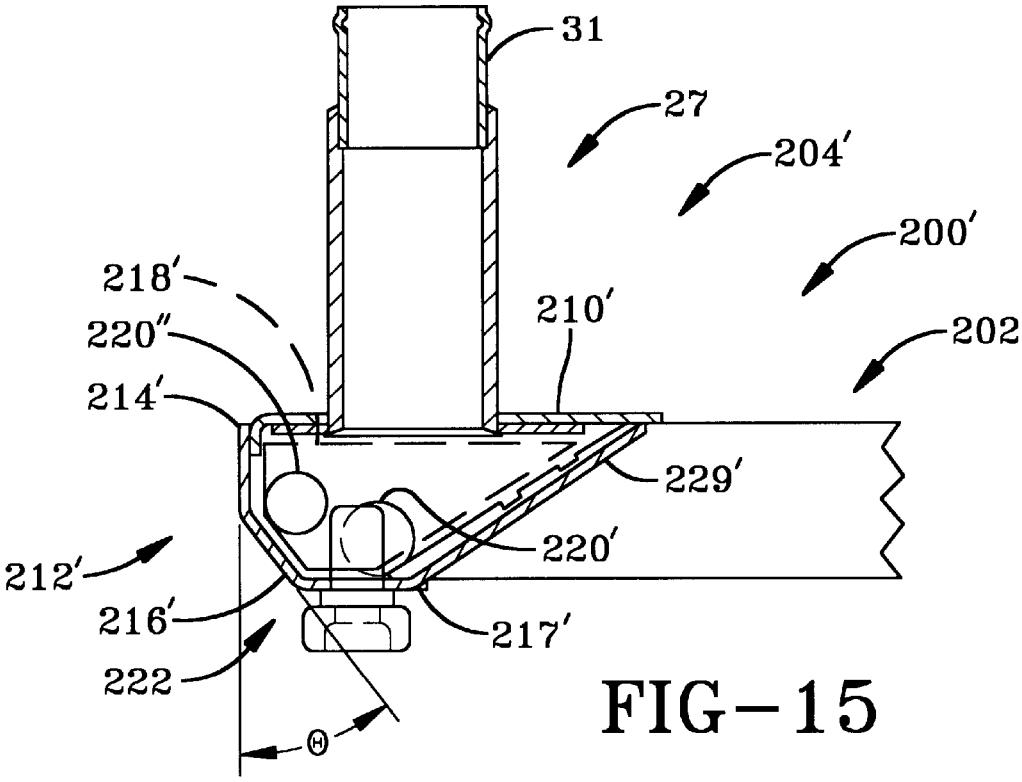
FIG. 15 is a cross-sectional view of a portion of a keel cooler, having several variations of the orifice(s) for the flow of coolant between the header and the outermost coolant flow tube, according to an aspect of the invention.

As a practical matter, it has been found that a circular orifice having a diameter as large as possible while maintaining the orifice in its wall within the header provides the desired coolant flow into the outermost tubes while enabling the proper amount of flow into the inner tubes as well. More than one orifice can also be provided, as shown in FIG. 15, where all of the members have the same numerical designators shown in FIGS. 6–12, except that some have a prime (') designation since angle θ has been changed to 40°, wall 214' is larger than wall 214, beveled wall 216' is shorter than wall 216 and the configuration of wall 218' has been modified from wall 218. Orifice 220 has been replaced by two orifices 220' and 220". Also, the anode assembly 222 and drain plug have been moved to a lower wall 217' of header 204'. Tubes 202 have also been moved along with the change in header 204'.

The orifice has been shown as one or more circular orifices, since circular orifices are relatively easy to provide. However, non-circular orifices are also within the scope of the invention, and a length of wall 218 could be dispensed with (as shown at 218' in FIG. 15).

Figure 16:
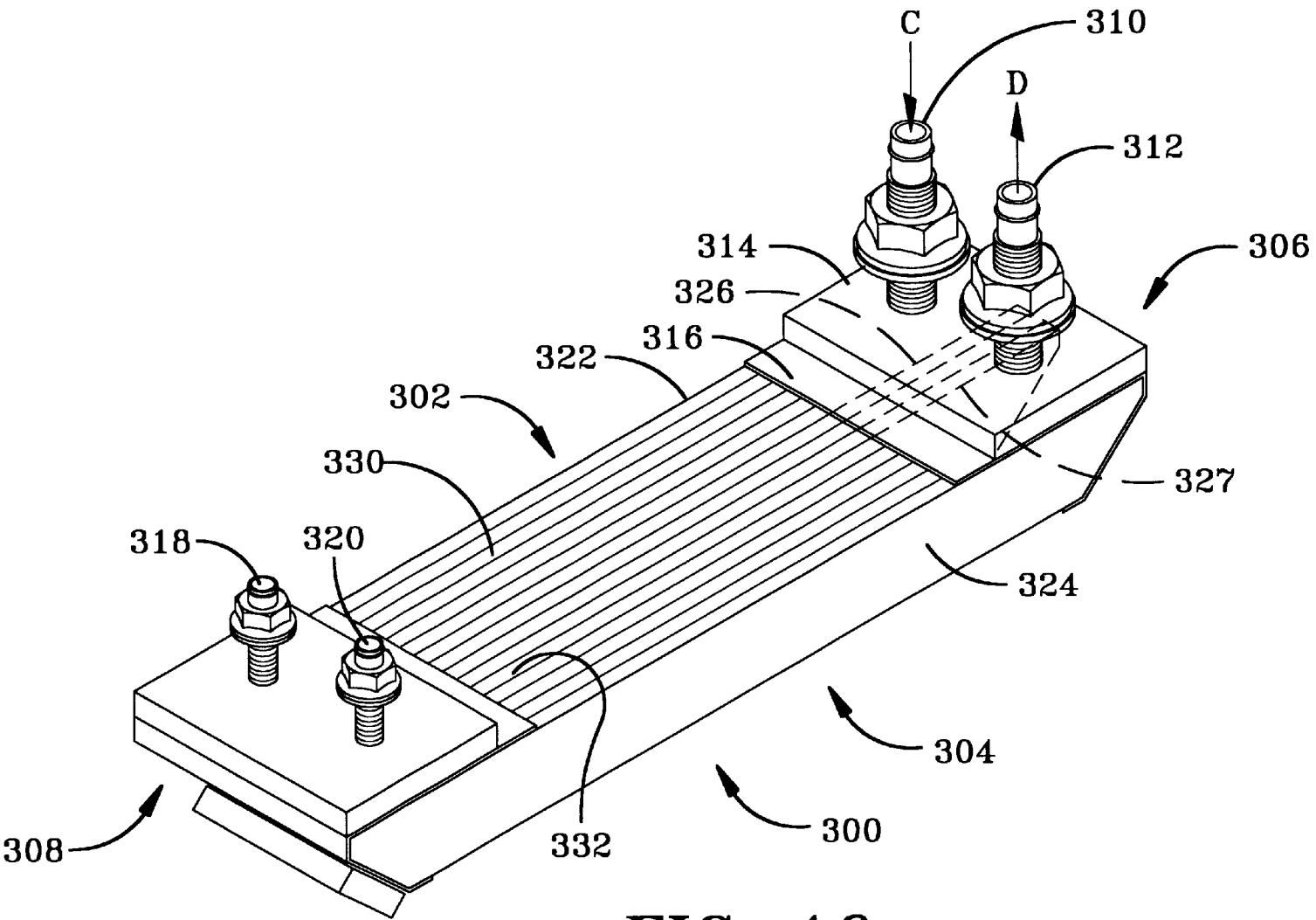
FIG. 16 is a pictorial view of a two pass keel cooler system according to the invention.
Figure 17:
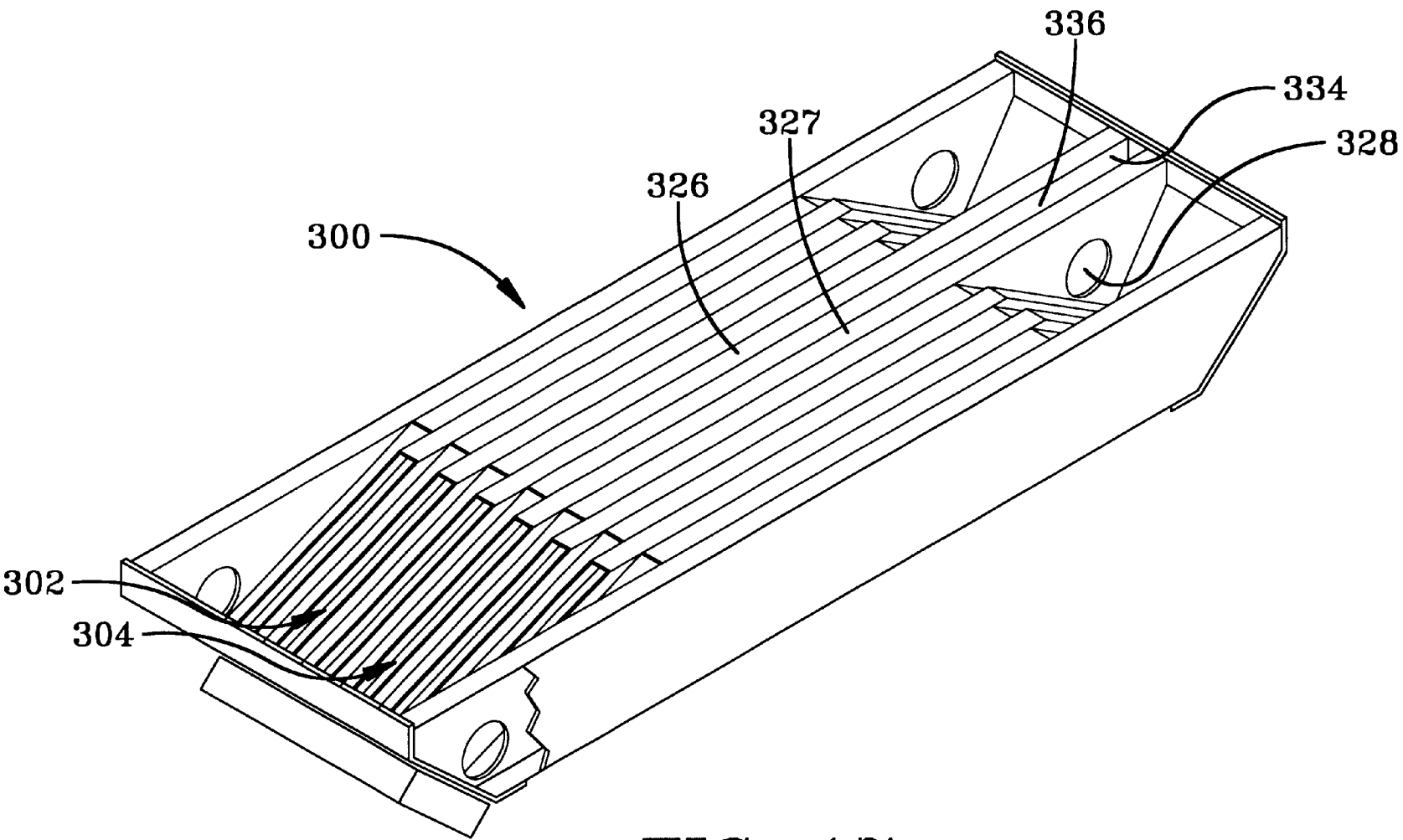
FIG. 17 is a cut away view of a portion of the header shown in FIG. 16.

The importance of the size and location of orifice 220 has other advantages as well. So far, only single pass keel cooler systems have been described. The problems with the size and location of the orifice to the outside tubes may be magnified for multiple pass systems and for multiple systems combined, as explained below. In two pass systems, the inlet and outlet nozzles are both disposed in one header, and coolant flows into the header via an inlet nozzle, through a first set of tubes from the first header into the second header (with no nozzles), and then back through a second set of tubes at a lower pressure—and finally out from the header via an outlet nozzle. Referring to FIGS. 16 and 17, a two pass keel cooler 300 according to the invention is shown. Keel cooler 300 has two sets of coolant flow tubes 302, 304, a header 306 and an opposite header 308. Header 306 has an inlet nozzle 310 and an outlet nozzle 312, which extend through a gasket 314. Gasket(s) 314 is located on roof 316 of header 306. The other header 308 has no nozzles, but rather has one or two stud bolt assemblies 318, 320 for connecting the portion of the keel cooler which includes header 308 to the hull of the vessel. The hot coolant from the engine or generator of the vessel enters nozzle 310 as shown by arrow C, and the cooled coolant returns to the engine from header 306 through outlet nozzle 312 shown by the arrow D. Outer tubes 322, 324 are like outer tubes 208 in FIGS. 7, 8 and 11 in that orifices corresponding to orifice 220 directs coolant into tube 322 and from tube 324. In addition, a tube 326 serves as a separator tube for delivering inlet coolant from header 306 to header 308, and it has an orifice (not shown) for receiving coolant for separator tube 326 under high pressure from a part of header 306 as discussed below. Similarly, a tube 327 which is the return separator tube for carrying coolant from header 308, also has an orifice 328 in header 306.

For space limitations or assembly considerations, sometimes (as noted above) it is necessary to remove the inner wall or a section of the inner tube instead of one or the other of the orifices. Other times, a separator plate is used and the standard angle interior tubes are used instead of separator tubes.

Keel cooler 300 has one set of coolant flow tubes 302 for carrying hot coolant from header 306 to header 308, where the direction of coolant flow is turned 180° by header 308, and the coolant enters a second set of tubes 304 for returning the partially cooled coolant back to header 306. Thus, coolant under high pressure flows through tubes 302 from header 306 to header 308, and the coolant then returns through tubes 304, and subsequently through nozzle 312 to the engine or other heat source of the vessel. Walls 334 and 336 (shown in FIG. 17) of tubes 326 and 327 in header 306 are solid, and act as separators to prevent the mixing of the hot coolant going into coolant flow tubes 302, and the cooled coolant flowing from tubes 304. There is a fairly uniform rate of flow through the tubes in both directions. Such efficient systems have been unable to be produced under the prior art, since the pressure drop across all six (or as many as would be realistically considered) orifices made the prior keel coolers too inefficient due to poor coolant distribution to be operated without a substantial additional safety factor. That is, in order to have two pass systems, prior one piece keel cooler systems having two pass arrangements are up to 20% larger than those required pursuant to the present invention to provide sufficient heat exchange surfaces to remove the required amount of heat from the coolant while attempting to maintain acceptable pressure drops.

The keel cooler system shown in FIG. 16 has 8 flow tubes. However, the two pass system would be appropriate for any even number of tubes, especially for those above two tubes. There are presently keel coolers having as many as 24 tubes, but it is possible according to the present invention for the number of tubes to be increased even further. These can also be keel coolers with more than two passes. If the number of passes is even, both nozzles are located in the same header. If the number of passes is an odd number, there is one nozzle located in each header.

Figure 18:
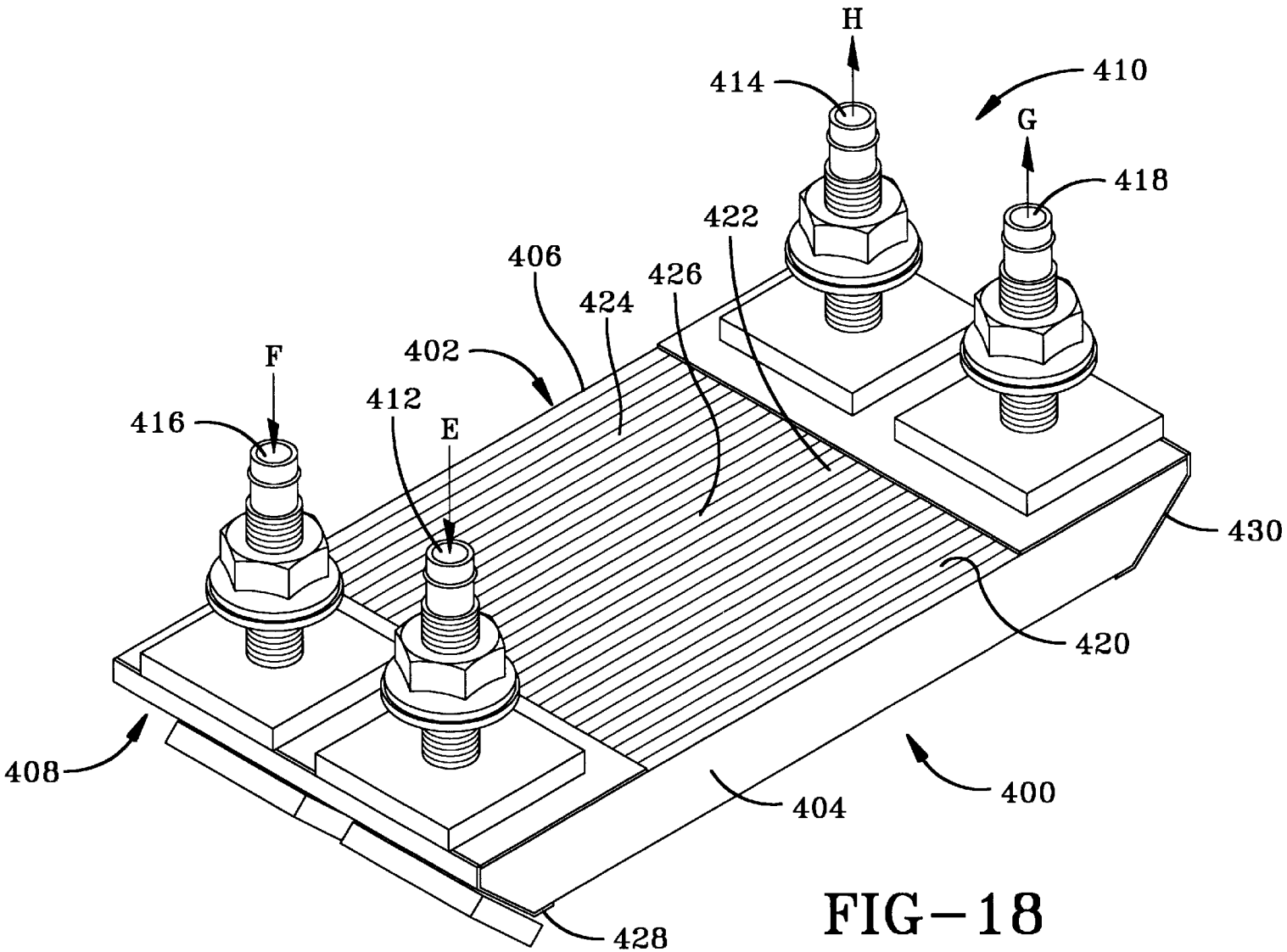
FIG. 18 is a pictorial view of a multiple systems combined, having two single pass portions, according to the invention.

Another aspect of the present invention is shown in FIG. 18, which shows a multiple systems combined keel cooler which has heretofore not been practically possible with one-piece keel coolers. Multiple systems combined can be used for cooling two or more heat sources, such as two relatively small engines or an after cooler and a gear box in a single vessel. Although the embodiment shown in FIG. 18 shows two keel cooler systems, there could be additional ones as well, depending on the situation. As explained below, the present invention allows multiple systems to be far more efficient than they could have been in the past. Thus, FIG. 18 shows a multiple systems keel cooler 400. Keel cooler 400 has a set of heat conducting or coolant flow tubes 402 having outer tubes 404 and 406, which have orifices at their respective inner walls which are similar in size and position to those shown in the previously described embodiments of the invention. For two single pass, multiple systems combined, keel cooler 400 has identical headers 408 and 410, having inlet nozzles 412, 416 respectively, and outlet nozzles 414, 418 respectively. Both nozzles in respective headers 408 and 410 could be reversed with respect to the direction of flow in them, or one could be an inlet and the other could be an outlet nozzle for the respective headers. The direction of the coolant flow through the nozzles are shown respectively by arrows E, F, G and H. A set of tubes 420 for conducting coolant between nozzles 412 and 418 commence with outer tube 404 and terminate with separator tube 422, and a set of tubes 424 extending between nozzles 414 and 416, commencing with outer tube 406 and terminating with separator tube 426. The walls of tubes 422 and 426 which are adjacent to each other are solid, and extend between the end walls of headers 408 and 410. These walls thus form system separators, which prevent the flow of coolant across these walls, so that the tubes 420 form, in effect, one keel cooler, and tubes 424 form, in effect, a second keel cooler (along with their respective headers). Keel cooler 400 has beveled closed end portions 428, 430 as discussed earlier. This type of keel cooler can be more economical than having two separate keel coolers, since there is a savings by only requiring two headers, rather than four. Multiple keel coolers can be combined in various combinations. There can be two or more one pass systems as shown in FIG. 18.

There can be one or more single pass systems and one or more double pass systems in combination as shown in FIG.

Figure 19:
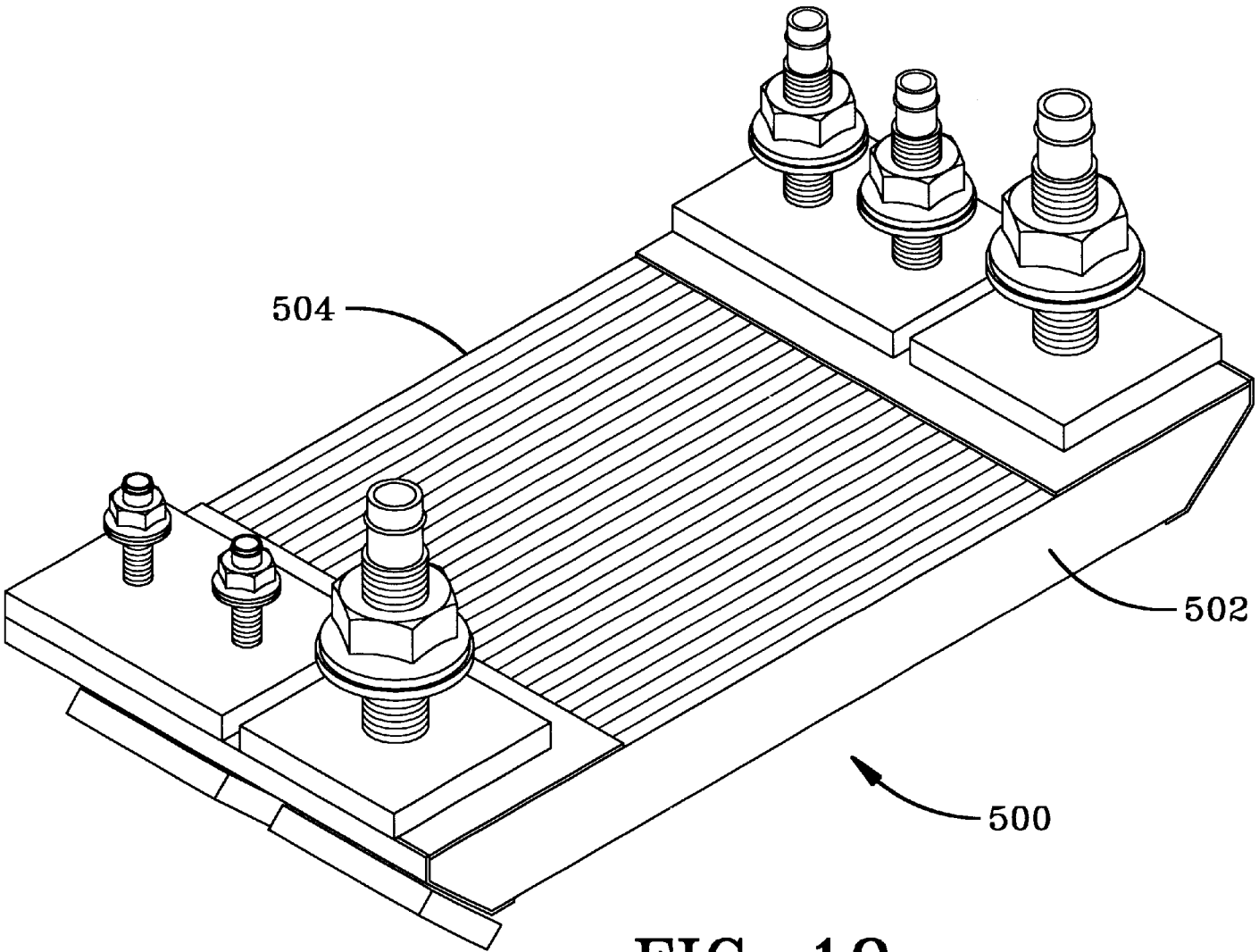
FIG. 19 is a pictorial view of a keel cooler according to the invention, having a single pass portion and a double pass portion.

19. In FIG. 19, a keel cooler 500 is depicted having a single pass keel cooler portion 502, and a double pass keel cooler portion 504. Keel cooler portion 502 functions as that described with reference to FIGS. 6–11, and keel cooler portion 504 functions as that described with reference to FIGS. 16 and 17. FIG. 19 shows a double pass system for one heat exchanger, and additional double pass systems could be added as well.

Figure 20:
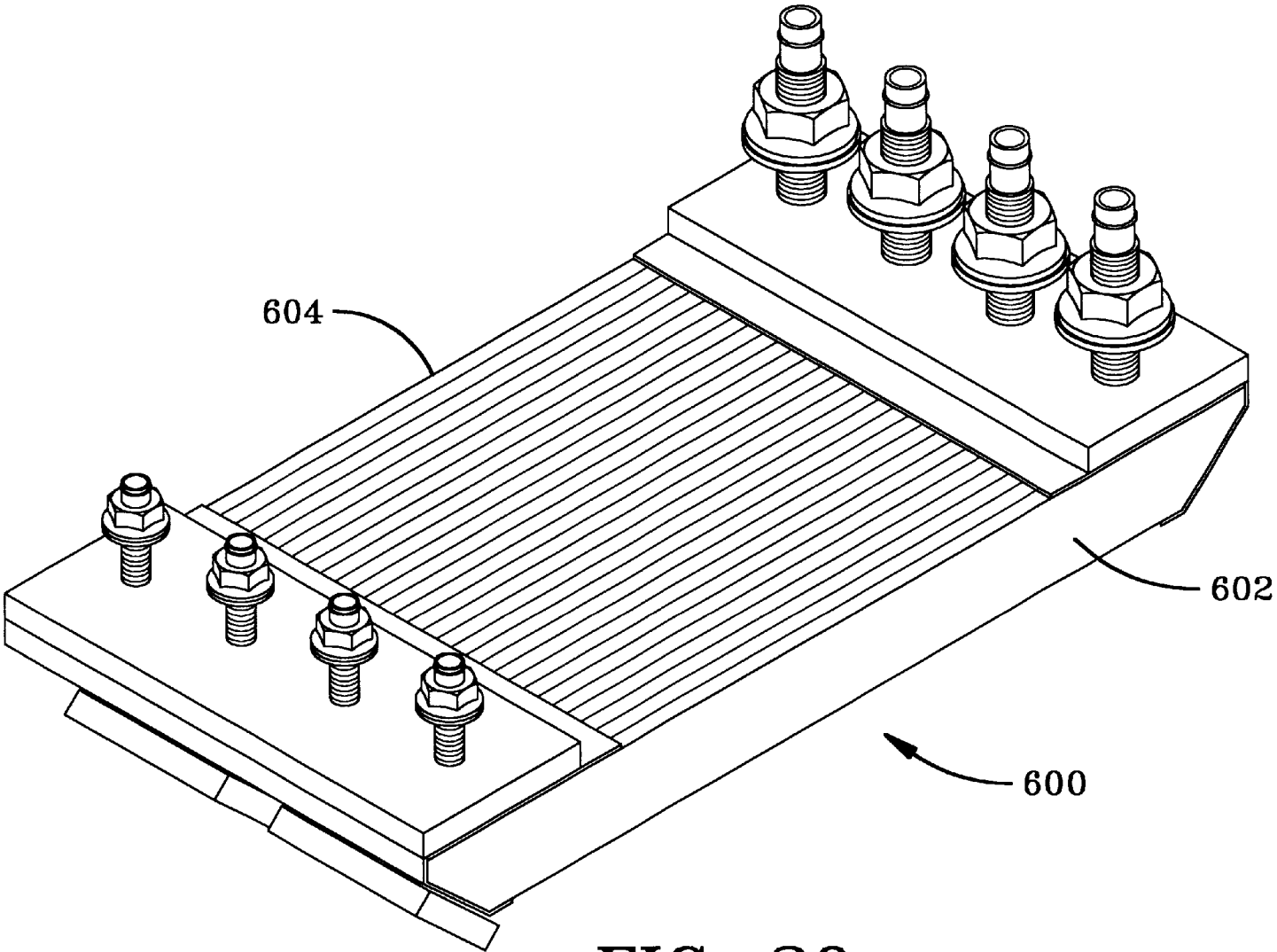
FIG. 20 is pictorial view of two double pass systems according to the invention.

FIG. 20, shows a keel cooler 600 having 2 double pass keel cooler portions 602, 604, which can be identical or have different capacities. They each function as described above with respect to FIGS. 16 and 17. Multiple coolers combined is a powerful feature not found in prior one-piece keel coolers. The modification of the special separator/tube design improves heat transfer and flow distribution while minimizing pressure drop concerns.

The keel coolers described above show nozzles for transferring heat transfer fluid into or out of the keel cooler. However, there are other means for transferring fluid into or out of the keel cooler; for example, in flange mounted keel coolers, there are one or more conduits such as pipes extending from the hull and from the keel cooler having end flanges for connection together to establish a heat transfer fluid flow path. Normally a gasket is interposed between the flanges. There may be other means for connecting the keel cooler to the coolant plumbing system in the vessel. This invention is independent of the type of connection used to join the keel cooler to the coolant plumbing system.

The invention has been described with particular reference to the preferred embodiments thereof, but it should be understood that variations and modifications within the spirit and scope of the invention may occur to those skilled in the art to which the invention pertains.

What is claimed is:

1. A header for a heat exchanger, the heat exchanger having a plurality of parallel tubes extending in a longitudinal direction and having generally rectangular cross sections, the tubes including a pair of outermost tubes and at least one inner tube located between the outermost tubes, the outermost tubes having an outside wall and a parallel inside wall, and the inner tubes having coolant ports, said header comprising:

an upper wall having an upper end portion, opposing side portions and an upper inner portion, said upper end portion and said upper inner portion being located in a plane, and an inlet/outlet opening for permitting the flow of coolant between an inlet/outlet and said header, said upper wall having a length extending between said upper end portion and said upper inner portion;

a lower wall located below said upper wall, said lower wall having a lower end portion, opposing side portions and a lower inner portion, said lower wall having a length extending between the lower end portion and the lower inner portion, said length being less than the length of said upper wall and disposed inwardly from both the upper end portion and the upper inner portion of said upper wall;

an end wall extending transversely from the end portion of said upper wall and terminating below said upper wall and above said lower wall;

an inclined surface extending between the inner portions of said lower wall and said upper wall, and including the open end(s) of the at least one inner tube to said header;

outside side walls extending between the side portions of said upper wall and said lower wall, said outside side walls each being an extension of the outside wall of the outermost tube of the heat exchanger;

inside side walls parallel to said outside side walls, said inside side walls each being an extension of the inside wall of the outermost tube; and a beveled wall extending between the termination of said end wall and the end portion of said lower wall and beveled with respect to said longitudinal direction from said upper wall to said lower wall towards said tube to reduce the turbulence of coolant flow to and/or from said parallel tubes and increase ambient fluid flow to the exterior surfaces of said parallel tubes compared to a non-beveled wall;

the inner surfaces of said inside side walls, upper wall, end wall, bottom wall, beveled wall and inclined surface forming a header chamber;

said inside side walls each having an orifice for permitting the flow of coolant between said header chamber and the respective outermost tube;

said orifice being disposed at least partly over said inclined surface when viewed in a transverse direction with respect to the longitudinal direction and at least partly beneath said inlet/outlet opening.

2. A header according to claim 1 wherein said orifice is a circular orifice.

3. A header according to claim 1 wherein said orifice is a circular orifice generally tangent to said bottom wall.

4. A header according to claim 1 wherein said orifice is a circular orifice whose size is the maximum size that will fit on said inner wall in said header chamber.

5. A header according to claim 1 wherein the parallel tubes have an internal cross sectional area, and wherein said orifice has an area of at least 1½ times the internal cross sectional area of each of the parallel tubes.

6. A header according to claim 5 wherein the area of said orifice is about twice the area of each of the parallel tubes.

7. A header according to claim 1 wherein the side walls having said orifice have an internal cross sectional area, and wherein said orifice has an area of at least 1½ times the internal cross sectional area.

8. A header according to claim 1 wherein said orifice has an area substantially as large as the largest circular orifice which will fit in said side walls at the location of said orifice.

9. A header according to claim 1 wherein said orifice is one of a plurality of orifices.

10. A header according to claim 1 wherein each of said orifices covers substantially the respective inside side walls.

11. A header according to claim 1 and further including an anode assembly located on said beveled wall.

12. A header according to claim 11 wherein said beveled wall has an interior side and an exterior side, and wherein said anode assembly has an anode bar located on the exterior side of said beveled wall, and said anode bar does not extend beyond said end wall.

13. A header according to claim 1 and further including a drain assembly including a drain hole located in said beveled wall, and a drain plug locatable in said drain hole, said drain plug extending outwardly from said beveled wall.

14. A header according to claim 13 wherein said drain plug does not extend below said lower wall.

15. A one-piece heat exchanger comprising:

a plurality of coolant flow tubes extending in a longitudinal direction for carrying coolant fluid and for transferring heat from the coolant fluid to a fluid heat sink, said coolant flow tubes having inner tubes and exterior side tubes, said inner tubes having at least one set of open ends in proximity to each other; and a header connected to said coolant flow tubes at said set of open ends of said tubes, said header having an inlet end portion for receiving coolant from and/or delivering coolant to said coolant flow tubes through said open ends, a generally flat upper wall having an opening for the flow of coolant into and/or out of said header, a closed end portion opposite said inlet end portion having an end wall transverse to said upper wall and a beveled bottom wall having a beveled portion terminating in a generally flat bottom wall generally parallel to said upper wall, said beveled portion being beveled with respect to said longitudinal direction of said coolant flow tubes to reduce the turbulence of coolant flow to and/or from said coolant flow tubes and increase ambient fluid flow to the exterior surfaces of said coolant flow tubes compared to a non-beveled inlet end portion, and side walls comprising extensions of said exterior side tubes, each of said side walls including an outermost wall and an inner wall, said inner wall having an orifice for the flow of coolant between said header and said exterior tube of which said inner wall is an extension, said orifice being disposed at least partly over said inlet end portion and at least partly beneath said opening as viewed in a transverse direction with respect to the longitudinal direction, said beveled portion serving to direct internal coolant flow to and/or from said orifices.

16. A one-piece heat exchanger according to claim 15 wherein said orifice has an area substantially as large as the largest circular orifice which will fit in said side walls at the location of said orifice.

17. A one-piece heat exchanger according to claim 15 wherein said orifice is one of a plurality of orifices for the flow of coolant between said header and said exterior tube of which said inner wall is an extension.

18. A one-piece heat exchanger according to claim 15 wherein each of said orifices covers substantially the respective inside side walls.

19. A one-piece heat exchanger according to claim 15 and further including an anode assembly located on said beveled portion of said beveled bottom wall.

20. A one-piece heat exchanger according to claim 19 wherein said beveled portion has an interior side and an exterior side, and wherein said anode assembly has an anode bar located on the exterior side of said beveled portion, and said anode bar does not extend beyond said end wall.

21. A one-piece heat exchanger according to claim 15 and further including a drain assembly including a drain hole located on said beveled portion of said beveled bottom wall, and a drain plug locatable in said drain hole, said drain plug extending outwardly from said beveled portion.

22. A one-piece heat exchanger according to claim 21 wherein said drain plug does not extend below said flat bottom wall.

* * * * *